US007992677B2

(12) United States Patent
Kadandale

(10) Patent No.: US 7,992,677 B2
(45) Date of Patent: Aug. 9, 2011

(54) MOTOR VEHICLE EXHAUST LINE SILENCER

(75) Inventor: Murli Kadandale, Belfort (FR)

(73) Assignee: Faurecia Systemes d'Echappement, Nanterre (FR)

( * ) Notice: Subject to any disclaimer, the term of this patent is extended or adjusted under 35 U.S.C. 154(b) by 0 days.

(21) Appl. No.: 12/663,363

(22) PCT Filed: Jun. 5, 2008

(86) PCT No.: PCT/FR2008/051008

§ 371 (c)(1),
(2), (4) Date: Mar. 10, 2010

(87) PCT Pub. No.: WO2008/152336

PCT Pub. Date: Dec. 18, 2008

(65) Prior Publication Data

US 2010/0170744 A1 Jul. 8, 2010

(30) Foreign Application Priority Data

Jun. 8, 2007 (FR) ..... 07 55609

(51) Int. Cl.
*F01N 13/18* (2010.01)

(52) U.S. Cl. ..... 181/282; 181/264

(58) Field of Classification Search ..... 181/282, 181/264

See application file for complete search history.

(56) References Cited

U.S. PATENT DOCUMENTS

| | | | | |
|---|---|---|---|---|
| 4,132,286 | A | 1/1979 | Hasui et al. | |
| 4,396,090 | A | 8/1983 | Wolfhugel | |
| 4,736,817 | A * | 4/1988 | Harwood | 181/282 |
| 4,759,423 | A * | 7/1988 | Harwood et al. | 181/282 |
| 4,765,437 | A * | 8/1988 | Harwood et al. | 181/282 |
| 5,004,069 | A * | 4/1991 | Van Blaircum et al. | 181/282 |
| 5,012,891 | A * | 5/1991 | Macaluso | 181/282 |
| 5,252,788 | A * | 10/1993 | Emrick et al. | 181/282 |
| 5,448,831 | A | 9/1995 | Harwood | |
| 6,058,702 | A * | 5/2000 | Jorg Alexnat et al. | 60/322 |
| 6,135,237 | A | 10/2000 | Allman | |
| 6,341,664 | B1 | 1/2002 | Gerber | |
| 2005/0155817 | A1 * | 7/2005 | Brand et al. | 181/256 |

FOREIGN PATENT DOCUMENTS

| | | |
|---|---|---|
| EP | 0 856 647 | 8/1998 |
| FR | 2363695 | 3/1978 |
| FR | 2 502 693 | 10/1982 |
| JP | 2006-283645 | 10/2006 |

OTHER PUBLICATIONS

International Search Report dated Dec. 11, 2008, from corresponding PCT application.

* cited by examiner

*Primary Examiner* — Jeremy Luks
(74) *Attorney, Agent, or Firm* — Young & Thompson

(57) ABSTRACT

A motor vehicle exhaust line silencer includes: an upper shell (2) having a substantially flat upper end wall (16); and a lower shell (4) having a substantially flat lower end wall (24) parallel to the upper end wall (16), the upper and lower shells (2, 4) delimiting between them an internal volume (6) of the silencer (1). The silencer (1) includes at least an internal partition wall (12) substantially parallel to the upper (16) and lower (24) end walls and arranged in the internal volume (6), the upper (16) and lower (24) end walls having respective reliefs (48, 50, 52) projecting into the internal volume (6) and cooperating to immobilize the internal partition wall (12).

14 Claims, 2 Drawing Sheets

MOTOR VEHICLE EXHAUST LINE SILENCER

CROSS-REFERENCE TO RELATED APPLICATIONS

The present application claims priority to and incorporates by reference PCT/FR2008/051008 filed Jun. 5, 2008 and French Application No. 0755609 filed Jun. 8, 2007.

STATEMENT REGARDING FEDERALLY SPONSORED RESEARCH OR DEVELOPMENT

None.

THE NAMES OF THE PARTIES TO A JOINT RESEARCH AGREEMENT

None.

INCORPORATION-BY-REFERENCE OF MATERIAL SUBMITTED ON A COMPACT DISC

None.

BACKGROUND OF THE INVENTION

1. Field of the Invention

The invention relates in general to motor vehicle exhaust lines.

More precisely, the invention relates to a motor vehicle exhaust line silencer, of the type comprising:

an upper shell comprising a substantially flat upper end wall;

a lower shell comprising a substantially flat lower end wall parallel to the upper end wall, the upper and lower shells delimiting between them an internal volume of the silencer.

2. Description of Related Art

Such a silencer is known from JP-2006-283645, which describes a silencer comprising a plurality of internal pipes each rigidly fixed to both the upper end wall and the lower end wall. The pipes thus divide the internal volume of the silencer into a plurality of chambers.

Such a silencer is of low height, in other words there is a small gap between the upper end wall and the lower end wall. Using such a silencer thus allows the vehicle chassis to be lowered, and therefore increases the usable volume of said vehicle. However, for a given internal volume of the silencer, because of its low height said silencer must have a large area, and in particular a high ratio between its length and its width.

For a given internal volume, said silencer generates more noise than a silencer of greater height and smaller area. Moreover, the quantity of raw material, in particular of metal, required to produce said silencer, is greater. The noise generated is due to the vibration of the different parts forming the silencer under the effect of the exhaust gas flow.

In this context, the object of the invention is to propose a silencer of which the construction is suitable for obtaining a low height, a large area and a high length/width ratio, which has good acoustic performance and requires the use of a moderate quantity of raw material.

BRIEF SUMMARY OF THE INVENTION

Accordingly, the invention relates to a silencer of the above-mentioned type, characterised in that it comprises at least an internal partition wall substantially parallel to the upper and lower end walls and arranged in the internal volume, the upper and lower end walls having respective reliefs projecting into the internal volume and cooperating to immobilise the internal partition wall.

The silencer may also have one or more of the features below, taken individually or in any technically feasible combination:

the silencer comprises at least a pipe extending at least partially into the internal volume, said pipe being integral with the internal partition wall, at least one of the reliefs of the upper end wall and at least one of the reliefs of the lower end wall gripping the pipe between them;

the pipe comprises at least a protuberance projecting towards one of the upper or lower end walls, the or each protuberance being in contact with one of the reliefs of said end wall;

the pipe is an inlet pipe adapted for connecting the internal volume of the silencer with an upstream portion of the exhaust line;

the pipe is an outlet pipe adapted for connecting the internal volume of the silencer with a downstream portion of the exhaust line;

at least one of the reliefs of the upper end wall and at least one of the reliefs of the lower end wall are arranged substantially opposite one another and grip between them a planar zone of the internal partition wall;

the silencer comprises at least two studs integral with the internal partition wall and projecting on either side of the internal partition wall, the studs being arranged in a substantially coinciding manner, with one resting on a relief of the upper end wall and the other on a relief of the lower end wall;

at least one of the upper or lower end walls has stiffening ribs;

the internal partition wall is delimited by a peripheral edge of which at least a portion is gripped between the upper and lower shells;

the upper and lower shells are metal, the upper and lower end walls each having a thickness of between 0.5 and 1.5 millimeters;

the upper and lower end walls have a gap between them of less than 120 millimeters; and the upper and lower end walls are substantially rectangular and each is of a determined width and a length of between twice and six times the width.

BRIEF DESCRIPTION OF THE SEVERAL VIEWS OF THE DRAWINGS

Other features and advantages of the invention will emerge from the detailed description given below, as an indication and in no way limiting, with reference to the accompanying drawings, in which.

DETAILED DESCRIPTION OF THE INVENTION

Figure 1:
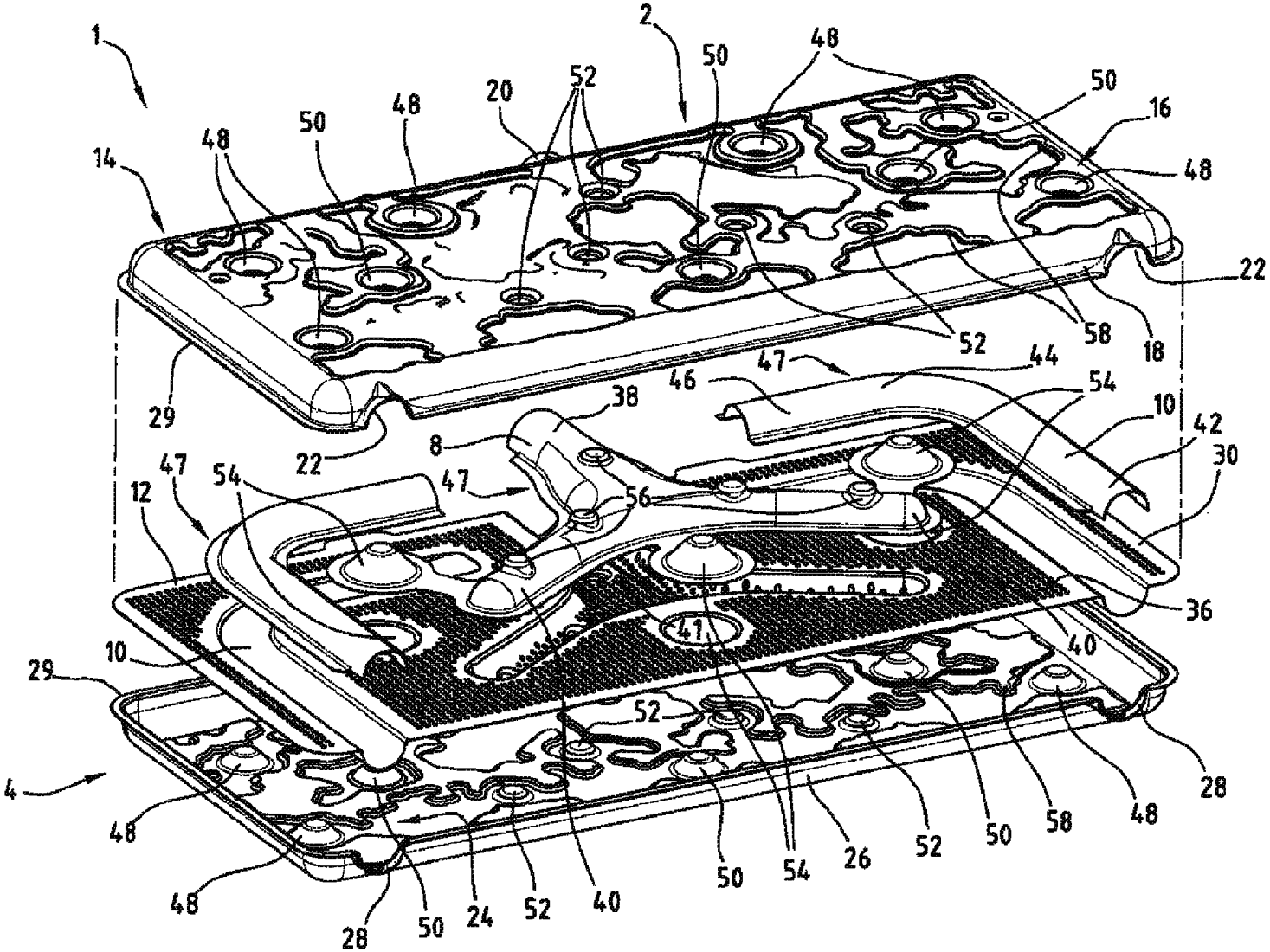
FIG. 1 is an exploded perspective view of a silencer according to the invention.

The silencer 1 illustrated in FIG. 1 comprises:

an upper shell 2;

a lower shell 4, the upper and lower shells delimiting between them an internal volume 6 of the silencer;

an inlet pipe 8;

two outlet pipes 10;

an internal partition wall 12 arranged in the internal volume 6; and means 14 for immobilising the internal partition wall 12 in relation to the upper 2 and lower 4 shells.

Provision is made for the silencer 1 to be inserted in the exhaust line of a motor vehicle. Thus, the inlet pipe 8 is able to connect the internal volume 6 of the silencer with an upstream portion of the exhaust line. This upstream portion typically comprises an exhaust manifold suitable for capturing the exhaust gases leaving the combustion chambers of the engine of the motor vehicle, and exhaust gas decontamination devices, notably a catalytic decontamination device, and/or a particle filter. The outlet pipes 10 are able to connect the internal volume 6 of the silencer with a downstream portion of the exhaust line. This downstream portion typically comprises at least a narrow hollow tube allowing the exhaust gases leaving the silencer to be released into the atmosphere.

Thus, the exhaust gases flow from the upstream portion of the exhaust line to the downstream portion through the silencer, the function of said silencer being to absorb the pressure waves in the exhaust gas flow resulting from the pulsating revolutions of the engine.

The upper shell 2 is in the form of a tray. It comprises a substantially flat rectangular upper end wall 16, and a raised edge 18 surrounding the upper end wall 16 over its entire perimeter. Three notches 20 and 22 are provided in the edge 18 to allow through the inlet pipe 8 and the two outlet pipes 10 respectively. The notch 20 is arranged in the centre of one of the long sides of the edge 18, and the notches 22 at either end of the other long side of the raised edge. The notches 20 and 22 are semicircular.

The lower shell 4 is of substantially the same form as the upper shell 2. It comprises a substantially flat rectangular lower end wall 24, and a raised edge 26 extending over the entire perimeter of the end wall 24. The respective concavities of the upper and lower shells are turned towards one another. The edge 26 also comprises three notches. One of the notches is arranged in the centre of one of the long sides of the edge 26 and is suitable for forming with the notch 20 of the edge 18 a circular opening for the inlet pipe 8 to pass through. This notch is not shown in FIG. 1. Two notches 28 are provided at either end of the other long side of the edge 26. These notches are arranged to form with the notches 22 of the edge 18 two circular openings for the two outlet pipes 10 to pass through.

Provision is made for the upper and lower shells 2 and 4 to be attached to one another by their respective edges 18 and 26.

Accordingly, the edges 18 and 26 each comprise a flange 29 folded to the outside of the silencer, said flange 29 following the entire perimeter of the edges 18 and 26. The flanges 29 are for example welded or crimped to one another.

The internal partition wall 12 is planar, and extends substantially parallel to the upper 16 and lower 24 end walls. It is rectangular, and of the same size as the end walls 16 and 24. It is delimited by a peripheral edge 30 which is held between the two folded flanges 29 of the upper and lower shells. The edge 30 is for example welded or crimped to the folded flanges 29.

Figure 2:
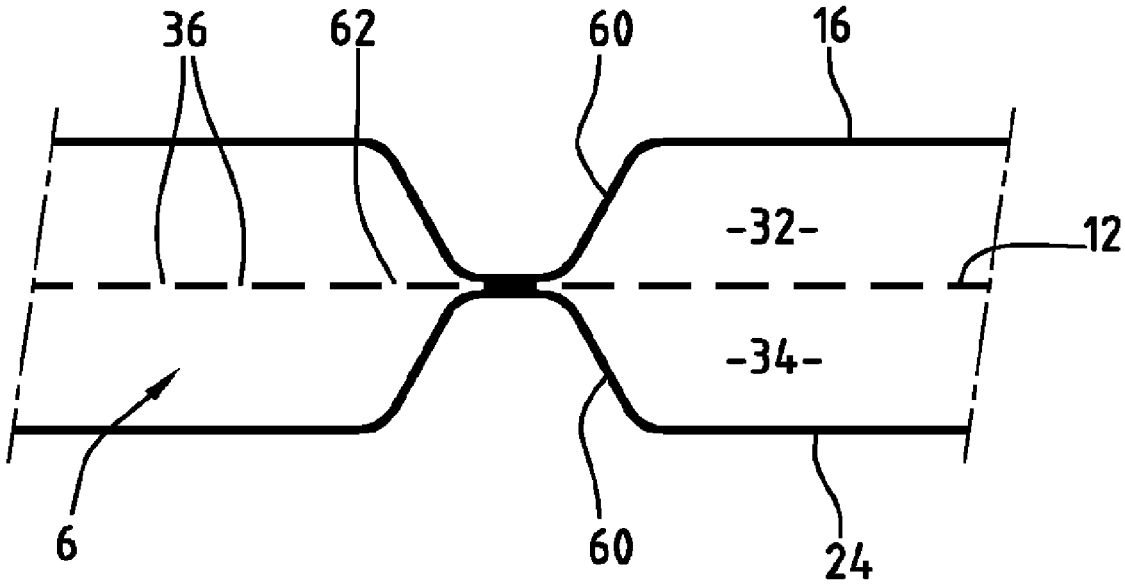
FIG. 2 is a view in cross section of a detail of a silencer according to a variant embodiment of the invention.

The internal partition wall 12 thus divides the internal volume 6 into two equal volumes, an upper volume delimited by the internal partition wall 12 and by the upper shell 2, and a lower volume 34 delimited by the internal partition wall 12 and the lower shell 4 (FIG. 2).

The internal partition wall 12 is pierced by numerous orifices 36 distributed substantially over its entire area and connecting the upper volume and the lower volume 32 and 34 to one another.

The inlet pipe 8 is generally star-shaped with three equal branches. A first branch 38 is inserted through the inlet of the silencer. The other two branches 40 are connected to the branch 38. The three branches have numerous orifices 42 connecting the interior of the inlet pipe with the internal volume of the silencer. The orifices 41 are distributed over the entire length of the branches 38 and 40 and open into the lower volume 34.

Each of the outlet pipes 10 is elbow-shaped. Each of the tubes 10 comprises a portion 42 inserted into a respective outlet of the silencer, extended by a portion 44 which has an open free end 46. The free end 46 opens into the upper volume 32.

The pipes 8 and 10 each consist for example of a hollow zone of semicircular cross section arranged in the internal partition wall 12, and a profile 47 of semicircular cross section attached to the partition wall 12.

The means 14 for immobilising the internal partition wall 12 in relation to the upper and lower shells 2 and 4 comprise a plurality of reliefs 48, 50 and 52 arranged on the upper and lower end walls. These reliefs 48, 50 and 52 project into the internal volume 6 of the silencer, the reliefs of the upper shell 2 projecting into the upper volume 32 and those of the lower shell projecting into the lower volume 34.

In the embodiment in FIG. 1, each of the upper and lower end walls 16 and 24 has six substantially tapered hollow reliefs 48. The reliefs 48 of the upper end wall 16 are situated opposite the reliefs 48 of the lower end wall 24.

On the upper end wall 16, three of the reliefs 48 are arranged substantially in an L at one of the ends of the end wall 16, and are in contact with one of the pipes 10. The other three reliefs 48 are also arranged in an L, at the other end of the end wall 16, and are in contact with the other pipe 10. For each pipe 10, one of the reliefs 48 is in contact with a zone of the pipe close to the open end 46, another relief 48 is in contact with the elbow of the pipe 10, and a relief 48 is in contact with a zone of the pipe 10 close to the outlet of the silencer.

The reliefs 48 of the lower end wall 24 are arranged in the same way in relation to the pipes 10. Thus, each pipe 10 is gripped at three points between a relief 48 of the upper end wall 16 and a relief 48 of the lower end wall 24. Each pipe 10 is gripped in a zone close to its open end 46, in a zone close to the outlet of the silencer and in the region of its elbow.

It will be observed that the pipes 10 are of circular cross section over their entire length and do not comprise reliefs for cooperating with the reliefs 48. The reliefs 48 rest directly on the casing of circular cross section of the pipe 10.

The means 14 comprise six studs 54 fixed rigidly to the internal partition wall 12. The studs 54 are arranged in coinciding pairs. Each pair of studs 54 arranged in a coinciding manner comprises a stud projecting towards the upper end wall 16 and a stud projecting towards the lower end wall 24, in relation to the partition wall 12. All the studs are tapered in form. Two coinciding studs 54 are attached to one another by their large bases.

For example, the three studs 54 projecting into the lower volume 34 towards the lower end wall 24 are hollow zones arranged in the internal partition wall 12. The three studs 54 projecting into the upper volume 32 towards the upper partition wall 16 are attached to the partition wall 12, and cover the other three studs. Typically, the three attached studs 54 may be formed in one piece with one of the profiles 47 attached to the internal partition wall 12 to form the pipe 8 or one of the pipes 10. For example, said three attached studs 54 may be formed in one piece with the attached profile 47 to form the inlet pipe 8.

The three hollow reliefs 50 of the upper end wall are arranged opposite the three hollow reliefs 50 of the lower end wall. All the reliefs 50 are tapered in form. The three reliefs 50 of the upper end wall rest on the three studs 54 projecting into the upper volume 32. Similarly, the three reliefs 50 of the lower end wall rest on the three studs 54 projecting into the lower volume 34. Thus, the silencer comprises three assemblies each made up of a relief 50 of the upper end wall resting on a first stud 54 integral with the partition wall 12, a second stud 54 coinciding with the first and integral with the partition wall 12, and a relief 50 of the lower end wall resting on the second stud 54. The two reliefs 50 and the two studs 54 thus form a stack of elements placed one on top of the other, and resting on one another.

As can be seen in FIG. 1, the reliefs 48 and 50, on each of the upper and lower end walls, project over the same height inside the internal volume. However, the reliefs 52 project over a lower height than the reliefs 48 and 50.

The upper and lower end walls 16 and 24 each have five hollow tapered reliefs 52. The reliefs 52 of each of the upper and lower end walls are in contact with five protuberances 56 arranged in the inlet pipe 8. The inlet pipe 8 therefore has five protuberances 56 projecting towards the upper end wall 16, and five protuberances 56 projecting towards the lower end wall 24. Said protuberances 56 each have the form of a substantially cylindrical stud.

The five studs 56 turned towards the upper end wall are distributed as follows: a stud 56 on the branch 38 inserted into the inlet of the silencer and two studs 56 on each of the branches 40 of the pipe 8. The distribution of the studs 56 turned towards the lower end wall is identical. The reliefs 52 of the upper end wall are arranged opposite the reliefs 52 of the lower end wall. Thus, the pipe 8 is gripped at five points between the respective reliefs 52 of the upper end wall and the lower end wall.

Each of the reliefs 48, 50 and 52 is fixed respectively on the pipe 10, on the corresponding stud 54 or on the corresponding stud 56 by welding, brazing or using rivets or screws, or by any other suitable method.

Furthermore, to increase the rigidity of the upper 16 and lower 24 end walls of the silencer, these end walls each have stiffening ribs distributed over their entire surface. These ribs consist for example of the peripheral edges of hollow zones 58 of suitable form and extent to stiffen the lower end wall or the upper end wall. Said hollow zones 58 are not very deep compared with the reliefs 48 and 50. They are for example of the same depth as the reliefs 52. They project into the internal volume. The hollow zones 58 are of much greater extent than the reliefs 48, 50 and 52. They have, as shown in FIG. 1, complex forms, with wider zones and narrower zones, and may for example extend in a winding manner between a plurality of reliefs 48, 50 or 52. The shape and depth of the hollow zones 58 are determined on a case by case basis, depending on the thermal and mechanical constraints to which the upper and lower end walls are subject, using computer calculation software, said calculations being complemented, if necessary, by tests.

The function of the ribs delineated by the hollow zones 58 is to increase the resonance frequency of the silencer, and increase the dynamic stiffness of the upper and lower end walls.

The silencer may comprise a sound absorbing material, for example made of glass fibre, in one of the upper or lower volumes 32 or 34 or in both volumes 32 and 34.

Due to the great rigidity conferred on the upper and lower end walls by the ribs and also by the fixing points formed by the reliefs 48, 50 and 52, it is possible to produce said end walls 16 and 24 from particularly thin metal. Thus, the upper and lower shells are produced typically from stamped sheet metal, the thickness of the metal sheet in the region of the upper and lower end walls after stamping being between 0.5 mm and 1.5 mm, preferably between 0.75 mm and 1.25 mm. Typically, the thickness of the metal sheet will be equal to 1 mm.

A silencer with a structure such as that described above may be of low height and large area, without compromising its rigidity or performance in terms of noise generation. Thus, in the example embodiment in FIG. 1, the silencer has a height, in other words a gap between the upper and lower end walls, for example of between 40 mm and 120 mm, preferably between 60 mm and 100 mm, with a value typically of 80 mm.

Moreover, the upper and lower end walls 16 and 24 have for example an area of 0.5 $m^2$.

Preferably, each of the upper and lower end walls has a ratio between its length and width of for example between 2 and 6, preferably between 3 and 5, and with a value typically of 4.

In a variant embodiment illustrated in FIG. 2, the upper and lower end walls 16 and 24 may comprise respective facing reliefs 60 gripping the planar zones 62 of the internal partition wall 12 between them. The reliefs 60 of the upper end wall project into the upper volume and are tapered in form. The reliefs 60 of the lower end wall project into the lower volume 34 and are tapered in form. As above, said reliefs 60 are fixed rigidly to the internal partition wall 12 by any suitable means. Said reliefs 60 may for example replace the reliefs 50 and the studs 54. They may also complement the reliefs 50 and the studs 54, according to requirements.

The silencer described above has many advantages.

Because it comprises at least an internal partition wall substantially parallel to the upper and lower end walls and arranged in the internal volume, the upper and lower end walls having respective reliefs projecting into the internal volume and cooperating with each other to immobilise the internal partition wall, the acoustic performance of the silencer is excellent, and it is particularly light.

In fact, the internal partition wall is held in position at multiple points relative to the upper and lower end walls, directly or indirectly by means of studs attached to the internal partition wall or by means of the inlet and outlet pipes which are also integral with the internal partition wall. Thus the internal partition wall generates less vibration due to the exhaust gas flow through the silencer, and generates less noise. This is also true of the upper and lower end walls, said end walls also having multiple fixing points distributed over their entire surface, and they too generate less vibration and less noise.

The fact that the internal partition wall is also held along its peripheral edge between the upper and lower shells helps to increase further the acoustic performance of the silencer.

The fact that the upper and lower end walls comprise multiple connection points distributed over their entire surface means that these end walls have increased rigidity. They may therefore be produced from a less thick material, with the effect that the silencer is lightened.

The fact that the upper and lower end walls have stiffening ribs allows a further reduction in the thickness of the materials used to form said end walls.

It is particularly advantageous for the ribs and reliefs of the upper and lower end walls to consist of hollow zones. In fact it is easy and economical to produce such hollow zones by stamping, during the operation to provide the upper and lower shells with their tray form.

It will be observed that maintaining the inlet and outlet pipes in position relative to the upper and lower shells is particularly effective because said pipes are not only fixed rigidly to the internal partition wall, but they are also fixed rigidly to the upper and lower shells.

The design of the silencer may be adapted easily on a case by case basis, depending on the specifications to be adhered to, in other words depending on the dimensions of the silencer (height, width, length), the thermal and mechanical constraints to be taken into account, whether statically or dynamically. This adaptation is produced by modifying the number, form, type and position of the reliefs and ribs on the upper and lower end walls.

Such adaptation may be carried out with no particular difficulty by calculations and, if necessary, by conducting validation tests.

As a result of the characteristics described above, it is possible to obtain light silencers with good acoustic performance, low height, large area and a particularly high length to width ratio.

The silencer described above may have numerous variants.

The upper and lower end walls may each comprise a variable number of reliefs 48, 50, 52 and 60. The number, type, form and position of said reliefs are adapted on a case by case basis.

The silencer may comprise a plurality of juxtaposed internal partition walls that are not integral with one another.

For example, the internal volume of the silencer may be divided into a plurality of chambers by pipes fixed rigidly to the upper and lower shells, as described in JP-2006-283645. In this case, each chamber may comprise its own internal partition wall.

The silencer may also comprise two internal partition walls of substantially the same size as the upper and lower end walls, and parallel to and placed on top of one another. In this case, the two internal partition walls are interconnected for example by tapered studs fixed rigidly to said internal partition walls.

The silencer may also comprise at the same time internal partition walls that are juxtaposed and placed on top of one another.

The silencer may comprise two inlet pipes or even more than two inlet pipes. Said inlet pipes may be of any form, including star-shaped, elbowed, rectilinear, etc.

The silencer may also comprise a single outlet pipe, or more than two outlet pipes. Said outlet pipes may be of any form, including rectilinear, elbowed, etc.

The reliefs 48 of the upper end wall may be offset in relation to the reliefs 48 of the lower end wall and thus not be placed opposite said reliefs of the lower end wall. Similarly, the reliefs 52 of the upper end wall and the studs 56 cooperating therewith may be offset in relation to the reliefs 52 of the lower end wall, and to the studs 56 cooperating with the reliefs 52 of the lower end wall. Similarly, it is possible to offset the reliefs 50 of the upper end wall and the studs 54 cooperating therewith, in relation to the reliefs 50 of the lower end wall and the stud 54 cooperating therewith.

The reliefs 48, 50, 52 and 60 may take any form. They are not necessarily tapered. They may also be cylindrical, of round, square or rectangular cross section, or be of any other suitable form.

The ribs 58 do not necessarily project inside the silencer. They may also project outside the silencer.

Each upper or lower end wall may comprise reliefs 58 projecting inside and reliefs 58 projecting outside the silencer.

Preferably, the upper and lower shells are single layer, in other words they only comprise, as far as their thickness is concerned, a single sheet of metal. They define the outer surfaces of the silencer.

The invention claimed is:

1. A motor vehicle exhaust line silencer comprising:

an upper shell comprising a substantially flat upper end wall;

a lower shell comprising a substantially flat lower end wall parallel to the upper end wall, the upper and lower shells delimiting between them an internal volume of the silencer;

wherein the silencer comprises at least an internal partition wall substantially parallel to the upper and lower end walls and arranged in the internal volume, the upper and lower end walls having respective reliefs projecting into the internal volume and cooperating to immobilize the internal partition wall, the internal partition dividing the internal volume into an upper volume delimited by the internal partition wall and by the upper end wall, and a lower volume delimited by the internal partition wall and by the lower end wall, each of the upper and lower volume having at least one chamber delimited by side walls extending continuously from the internal partition wall to the upper and lower end wall respectively, the reliefs of the upper end wall being located away from the side walls of all the chambers of the upper volume and being distributed over the surface of the upper end wall, and the reliefs of the lower end wall being located away from the side walls of all the chambers of the lower volume and being distributed over the surface of the lower end wall.

2. The silencer according to claim 1, further comprising:

at least a pipe extending at least partially into the internal volume, said pipe being integral with the internal partition wall, at least one of the reliefs of the upper end wall and at least one of the reliefs of the lower end wall gripping the pipe between them.

3. The silencer according to claim 2, wherein the pipe comprises at least a protuberance projecting towards one of the upper or lower end walls, the or each protuberance being in contact with one of the reliefs of said end wall.

4. The silencer according to claim 2, wherein the pipe is an inlet pipe adapted for connecting the internal volume of the silencer with an upstream portion of the exhaust line.

5. The silencer according to claim 2, wherein the pipe is an outlet pipe adapted for connecting the internal volume of the silencer with a downstream portion of the exhaust line.

6. The silencer according to claim 1, wherein at least one of the reliefs of the upper end wall and at least one of the reliefs of the lower end wall are arranged substantially opposite one another and grip between them a planar zone of the internal partition wall.

7. The silencer according to claim 1, further comprising:

at least two studs integral with the internal partition wall and projecting on either side of the internal partition wall, the studs being arranged substantially in a coinciding manner and with one resting on a relief of the upper end wall and the other on a relief of the lower end wall.

8. The silencer according to claim 1, wherein at least one of the upper or lower end walls has stiffening ribs.

9. The silencer according to claim 1, wherein the internal partition wall is delimited by a peripheral edge of which at least a portion is gripped between the upper and lower shells.

10. The silencer according to claim 1, wherein the upper and lower shells are metal, the upper and lower end walls each having a thickness of between 0.5 and 1.5 millimeters.

11. The silencer according to claim 1, wherein the upper and lower end walls have a gap between them of less than 120 millimeters.

12. The silencer according to claim 1, wherein the upper and lower end walls are substantially rectangular and each is of a determined width and a length of between twice and six times the width.

13. The silencer according to claim 3, wherein the pipe is an inlet pipe adapted for connecting the internal volume of the silencer with an upstream portion of the exhaust line.

14. The silencer according to claim 3, wherein the pipe is an outlet pipe adapted for connecting the internal volume of the silencer with a downstream portion of the exhaust line.

* * * * *